US005252762A

United States Patent [19]

Denton

[11] Patent Number: 5,252,762

[45] Date of Patent: Oct. 12, 1993

[54] USE OF BASE-TREATED INORGANIC POROUS ADSORBENTS FOR REMOVAL OF CONTAMINANTS

[75] Inventor: Dean A. Denton, Baltimore, Md.

[73] Assignee: W. R. Grace & Co.-Conn., New York, N.Y.

[21] Appl. No.: 679,787

[22] Filed: Apr. 3, 1991

[51] Int. Cl.[5] ..... C11B 7/00

[52] U.S. Cl. ..... 554/196; 554/191; 554/192; 554/195; 502/408; 502/416

[58] Field of Search ..... 260/427, 428, 428.5; 554/191, 192, 195, 196; 502/408, 416

[56] References Cited

U.S. PATENT DOCUMENTS

| | | | |
|---|---|---|---|
| 1,386,471 | 8/1921 | Tuttle et al. | 260/427 |
| 1,603,314 | 10/1926 | Caldwell | 554/191 |
| 1,705,824 | 3/1929 | O'Deen | 260/427 |
| 2,639,289 | 5/1953 | Vogel | 260/427 |
| 3,231,390 | 1/1966 | Hoover | 99/118 |
| 3,284,213 | 11/1966 | Van Akkeren | 99/118 |
| 3,354,188 | 11/1967 | Bock et al. | 260/424 |
| 3,954,819 | 4/1976 | Husch | 260/428 |
| 3,984,447 | 10/1976 | Cooper et al. | 260/420 |
| 4,112,129 | 9/1978 | Duensing et al. | 426/417 |
| 4,150,045 | 4/1979 | Sinha | 260/424 |
| 4,330,564 | 5/1982 | Friedman | 424/417 |
| 4,499,196 | 2/1985 | Yuki | 502/64 |
| 4,609,500 | 9/1986 | Strecker | 260/427 |
| 4,629,588 | 12/1986 | Welsh et al. | 260/428 |
| 4,698,185 | 10/1987 | Dijkstra et al. | 260/403 |
| 4,735,815 | 4/1988 | Taylor et al. | 426/417 |
| 4,764,384 | 8/1988 | Gyann | 426/417 |
| 4,812,436 | 3/1989 | Staal et al. | 260/427 |
| 4,877,765 | 10/1989 | Pryor et al. | 502/408 |
| 4,913,922 | 4/1990 | Hawkes et al. | 426/117 |
| 4,939,115 | 7/1990 | Parker et al. | 502/401 |
| 4,956,126 | 9/1990 | Staal et al. | 260/428 |

FOREIGN PATENT DOCUMENTS

| | | |
|---|---|---|
| 3537384 | 11/1987 | Fed. Rep. of Germany . |
| 7332132 | 8/1975 | France . |
| 612169 | 3/1945 | United Kingdom . |

OTHER PUBLICATIONS

Swern (Ed.), Bailey's Industrial Oil and Fat Products, vol. 2, 4th Ed., pp. 253-259 (1982).

Vinyukova et al., "Hydration of Vegetable Oils by Solutions of Polarizing Compounds," Food and Feed Chem., vol. 17-9, pp. 12-15 (1984).

Tandy et al., "Physical Refining of Edible Oil," JAOCS, vol. 61, pp. 1253-1258 (Jul. 1984).

Blumenthal et al., "Isolation and Detection of Aklaline Contaminant Materials (ACM) in Used Frying Oils," JAOCS, vol. 63, pp. 687-688 (1986).

Augustin et al., "Relationships Between Measurements of Fat Deterioration During Heating and Frying in RBD Olein," JAOCS, vol. 64, pp. 1670-1675 (1987).

Duxbury, "Breaded Food, Frying Oil Enhanced by Oil Purifier," Food Processing, pp. 122-124 (Jun. 1990).

PQ Corporation, Britesorb® Oil Purifiers, Bulletin OP-202.

*Primary Examiner*—Jose G. Dees
*Assistant Examiner*—Deborah D. Carr
*Attorney, Agent, or Firm*—Steven Capella

[57] ABSTRACT

Adsorbents are provided which are suitable for use in the removal of contaminants selected from the group consisting of free fatty acids, soaps, phosphorus, metal ions and color bodies. The adsorbents comprise inorganic porous supports selected from the group consisting of substantially amorphous alumina, diatomaceous earth, clays, magnesium silicates, aluminum silicates and amorphous silica, treated with a base in such a manner that at least a portion of said base is retained in at least some of the pores of the support to yield base-treated inorganic porous adsorbents. Processes for removing free fatty acids, etc., from glyceride oils using these adsorbents are also provided.

15 Claims, No Drawings

USE OF BASE-TREATED INORGANIC POROUS ADSORBENTS FOR REMOVAL OF CONTAMINANTS

FIELD OF THE INVENTION

This invention relates to a method for treating glyceride oils by contacting the oils with an adsorbent capable of selectively removing trace contaminants. More specifically, it has been found that novel base-treated inorganic adsorbents of suitable porosity have superior properties for the removal of contaminants such as free fatty acids (FFA) and soaps from glyceride oils; other contaminants are removed as well. Suitable supports include amorphous silicas or aluminas, clays, diatomaceous earth, etc.

The term "glyceride oils" as used herein is intended to encompass all lipid compositions, including vegetable oils and animal fats and tallows. This term is primarily intended to describe the so-called edible oils, i.e., oils derived from fruits or seeds of plants and used chiefly in foodstuffs, but it is understood that oils whose end use is as non-edibles are to be included as well. It should be recognized that the method of this invention also can be used to treat fractionated streams derived from these sources. Further, the method may be used in the initial refining of glyceride oils as well as in the reclamation of used oils. Throughout the description of this invention, unless otherwise indicated, reference to the removal of contaminants or free fatty acids refers to the removal of free fatty acids, associated soap contaminants, phosphorous, metal ions and/or color bodies, as may be present in the oil to be treated.

BACKGROUND OF THE INVENTION

Crude glyceride oils, particularly vegetable oils, are refined by a multi-stage process, the first step of which is degumming by treatment typically with water or with a chemical such as phosphoric acid, citric acid or acetic anhydride. Gums may be separated from the oil at this point or carried into subsequent phases of refining. A broad range of chemicals and operating conditions have been used to perform hydration of gums for subsequent separation. For example, Vinyukova et al., "Hydration of Vegetable Oils by Solutions of Polarizing Compounds," Food and Feed Chem., Vol. 17-9, pp. 12-15 (1984), discloses using a hydration agent containing citric acid, sodium chloride and sodium hydroxide in water to increase the removal of phospholipids from sunflower and soybean oils.

After degumming, the oil may be refined by a chemical process including neutralization, bleaching and deodorizing steps. Alternatively, a physical process may be used, including a pretreating and bleaching step and a steam refining and deodorizing step. State-of-the-art processes for both physical and chemical refining are described by Tandy et al. in "Physical Refining of Edible Oil," J. Am. Oil Chem. Soc., Vol. 61, pp. 1253-58 (July 1984).

An object of either refining process is to reduce the levels of contaminants, including free fatty acids, phosphorus (typically as phospholipids), metal ions, soaps and color bodies or pigments, which can lend off colors, odors and flavors to the finished oil product. Ionic forms of the metals calcium, magnesium, iron and copper are thought to be chemically associated with free fatty acids and to negatively effect the quality and stability of the final oil product. Free fatty acids are conventionally removed by means of caustic refining as well as steam distillation under reduced pressure.

One widespread use of glyceride oils is for frying food items. The continuous use of deep fat fryers, however, causes the oil to become depleted and contaminated. Spent frying oil from a deep fat fryer contains various particulate and nonparticulate contaminants. Parts of the food product break off during frying and remain in the cooking oil. Many food products are coated with a seasoned coating prior to immersion in the frying oil, and particles of the coating break free from the product and remain in the cooking oil. In addition, fats, blood, etc., from the food product itself will be extracted into the frying oil and may undergo degradation during the frying process. Extraction of fat into the oil contaminates the oil with some of the same compounds which must be removed from crude glyceride oils during initial refining: phospholipids, metal ions, FFAs, etc.

It is customary in fast food restaurants to filter particulate matter from the frying oil at the end of the day. Merely filtering the spent frying oil will only remove particulate contaminants. Phospholipids, FFAs, metal ions and color bodies remain in the filtered oil. Accordingly, an object of the present invention to provide a process for reclaiming spent glyceride oils by removing contaminants which accumulate in the oil during the frying process.

The removal of free fatty acids from crude and spent edible oils has been the object of a number of previously proposed physical and chemical process steps. For example, U.S. Pat. No. 4,499,196 (Yuki) discloses an adsorbing deacidifier for use in oily substances, wherein the deacidifier comprises dehydrated natural or synthetic zeolites and an aqueous solution of sodium hydroxide or potassium hydroxide adsorbed into the zeolites. U.S. Pat. No. 4,150,045 (Sinha) discloses a method for removing free fatty acids, phospholipids and peroxide compounds from crude vegetable oil using a bed of activated carbon impregnated with magnesium oxide (MgO). U.S. Pat, No. 1,386,471 (Tuttle et al.) discloses the use of alkalized fullers' earth (prepared by shaking fullers' earth with lime water) to remove volatile substances from cacao oil. U.S. Pat. No. 4,913,922 (Hawkes et al.) describes a process for removing free fatty acids using a precoat filter bed containing diatomaceous earth to separate particulates, which stops further release of free fatty acid from breakdown of organic particulates, and then mixing the oil with calcium silicate as the adsorbent for dissolved free fatty acids. U.S. Pat. No. 4,112,129 (Duensing et al.) teaches the utility of a composition for the reduction of the rate of free fatty acid buildup in cooking oils, which consists of diatomite, synthetic calcium silicate hydrate and synthetic magnesium hydrate. U.S. Pat. No. 4,764,384 (Gyann) describes treating spent cooking oil with a filtering media consisting of synthetic amorphous silica, synthetic amorphous magnesium silicate, diatomaceous earth, and synthetic amorphous silica-alumina. It is disclosed that synthetic amorphous silica alone will not be an efficient filtering media, but that additional materials are necessary for removal of free fatty acids and proper bleaching, as well as to achieve adequate flow rates through the filter.

SUMMARY OF THE INVENTION

It now has been found that trace contaminants, most importantly free fatty acids, can be removed effectively and efficiently from glyceride oils by adsorption onto the base-treated inorganic porous adsorbents of this invention. There is provided by this invention a novel process for the removal of contaminants, selected from the group consisting of free fatty acids, soaps, phosphorous, metal ions and color bodies, from glyceride oil. The process comprises the steps of selecting a glyceride oil with a free fatty acid content of greater than about 0.01% by weight; selecting an inorganic porous support from the group consisting of substantially amorphous alumina, diatomaceous earth, clays, magnesium silicates, aluminum silicates and amorphous silica; treating the support with a base in such a manner that at least a portion of said base is retained in at least some of the pores of the support to yield a base-treated adsorbent; contacting the glyceride oil with the base-treated adsorbent for a time sufficient for at least a portion of the contaminants to be removed from the glyceride oil by adsorption onto the base-treated adsorbent; and separating the contaminant-depleted glyceride oil from the adsorbent.

Further provided by this invention is a novel adsorbent suitable for use in the removal of contaminants, selected from the group consisting of free fatty acids, soaps, phosphorous, metal ions and color bodies, from glyceride oils. The support comprises an inorganic porous support selected from the group consisting of substantially amorphous alumina, diatomaceous earth, clays, magnesium silicates, aluminum silicates and amorphous silica, the support being treated with a base in such a manner that at least a portion of the base is retained in at least some of the pores of the adsorbent.

The use of a base-treated inorganic porous adsorbent of this invention is substantially more convenient than separate treatments with base and with adsorbent would be. The base alone is not easily miscible in the oil and one function of the adsorbent is to facilitate dispersion of the supported base in the oil. Moreover, separate storage of base is eliminated, as is the separate process step for the addition of the base. Separate base treatment also requires centrifugal separation of the base from oil and the use of large quantities of solids such as bleaching earth to adsorb contaminants from the separated oil phase. By contrast, the method of this invention utilizes an efficient method for bringing the oil and base together, followed by a simple physical separation of the solid adsorbent from the contaminant-depleted oil.

Adsorption of free fatty acids onto the base-treated inorganic porous adsorbents of this invention in the manner described can, in some cases, eliminate any need to use clay or bleaching earth adsorbent in the refining process. Elimination of clay or bleaching earth results in increased on-stream filter time in the refining operation due to the I5 superior filterability of the adsorbent of this invention. Moreover, the base-treated inorganic porous adsorbent of this invention avoids significant oil losses previously associated with the clay or bleaching earth filter cake. In addition, since spent bleaching earth has a tendency to undergo spontaneous combustion, reduction or elimination of this step will yield an occupationally and environmentally safer process. Still further, lower adsorbent usages or loadings (wet or dry basis) can be achieved than would be required using clays or bleaching earths alone. Thus, appreciable cost savings can be realized with the use of the base-treated inorganic porous adsorbent of this invention, which can allow for significantly reduced adsorbent loadings and base usage. The overall value of the product is further increased since aqueous soapstock, an undesirable by-product of conventional refining techniques, is generally readily removed.

In addition to FFA and soap removal, the adsorbents of this invention are expected to reduce levels of other contaminants (e.g., phospholipids, color bodies, metal ions, volatile decomposition products and partially oxidized compounds associated with soaps and FFAs in micellar or other complex forms. This is true in initial refining applications and is of particular importance in reclamation applications where removal of these contaminants results in a dramatic improvement of oil appearance, taste and stability.

DETAILED DESCRIPTION OF THE INVENTION

This invention provides adsorbents and processes for the adsorptive removal of contaminants comprising free fatty acids (FFAs) from glyceride oils. The process described herein can be used for the removal of free fatty acids and other contaminants from any glyceride oil, whether edible or inedible, for example, soybean, peanut, rapeseed, corn, sunflower, palm, coconut, olive, cottonseed, rice bran, safflower, flax seed, etc. Treatment of animal oils or fats, such as tallows, lard, milkfat, fish liver oils, etc., is anticipated as well. Removal of free fatty acids from these oils is a significant step in the oil refining process because the decomposition of free fatty acids into peroxides, polymers, ketones and aldehydes can cause undesirable colors, odors and flavors in the finished oil.

Typically, the acceptable concentration of free fatty acids in the treated oil product should be less than about 1.0 wt %, preferably less than about 0.05 wt %, more preferably less than about 0.03 wt %, and most preferably less than about 0.01 wt %, according to general industry practice. Removal of free fatty acids to the lower levels set forth above will provide a better quality oil for use in edible oil products. While acceptable FFA levels in fully refined oils typically are less than 0.05 wt %, it will be understood that acceptable levels may be somewhat more variable in reclamation of used frying oils.

In conjunction With FFA removal, the process of this invention removes soaps from edible oils. These soaps themselves have a deleterious effect on the refined oil products and foods cooked in oil. The presence of soaps in oil increases the oxidative decomposition of the oil. Oils containing excessive amounts of soaps may smoke during frying and may yield fried products with off-tastes. Typically, the acceptable concentration of soaps in the finished oil product should be less than about 1.0 ppm, preferably zero. An optimum level for soaps in reclaimed cooking oil is less than 1 ppm. Thus, removal of soaps to the lower levels set forth above is desirable and will yield oils acceptable for frying.

Without being limited to any particular theory, it is believed that FFAs are neutralized upon contact with the base-treated adsorbents, being converted into soaps in situ. The soaps are removed from the oil as they are formed by physical adsorption onto the adsorbent of this invention and/or onto one or more other adsorbents added for that particular purpose. For example, amorphous silica or clay may be added where high soap levels are expected or encountered.

The Adsorbents—The supports from which the base-treated inorganic porous adsorbents of this invention are prepared are selected from the group consisting of amorphous silica, substantially amorphous alumina, diatomaceous earth, clay, magnesium silicates and aluminum silicates. The supports are characterized by being finely divided, i.e., they preferably are comprised of particles in the range from about 10μ to about 100μ. They have surface areas in the range from about 10 to about 1200 square meters per gram. The supports preferably should have a porosity such that the base-treated adsorbent is capable of soaking up to at least about 20 percent of its weight in moisture. In addition, the supports preferably should contain at least some pores of sufficient size to permit access to at least some free fatty acids. One or more untreated supports or other adsorptive materials can be blended with one or more base-treated adsorbents of the invention.

It has been found that certain base-treated amorphous silicas are particularly well suited for removing contaminants from glyceride oils to yield oils having commercially acceptable levels of those contaminants and being substantially free of contaminating soaps. Thus, amorphous silica is a preferred support for use in this invention. For convenience, amorphous silica is used below to illustrate the supports used in preparing the base-treated inorganic porous adsorbents of this invention; the general teachings apply to other supports as well.

The term "amorphous silica" as used herein is intended to embrace silica gels, precipitated silicas, dialytic silicas and fumed silicas in their various prepared or activated forms. The specific manufacturing process used to prepare the amorphous silica is not expected to affect its utility in this method. Base treatment of the amorphous silica support selected for use in this invention may be conducted as a step in the silica manufacturing process or at a subsequent time. The base treatment process is described below.

Both silica gels and precipitated silicas are prepared by the destabilization of aqueous silicate solutions by acid neutralization. In the preparation of silica gel, a silica hydrogel is formed which then typically is washed to low salt content. The washed hydrogel may be milled, or it may be dried, ultimately to the point where its structure no longer changes as a result of shrinkage. The dried, stable silica is termed a "xerogel" if slow dried and termed an "aerogel" when quick dried. The aerogel typically has a higher pore volume than the xerogel. In the preparation of precipitated silicas, the destabilization is carried out in the presence of inorganic salts, which lower the solubility of silica and cause precipitation of hydrated silica. The precipitate typically is filtered, washed and dried. For preparation of xerogels or precipitates useful in this invention, it is preferred to dry them and then to add water to reach the desired water content before use. However, it is possible to initially dry the gel or precipitate to the desired water content. Dialytic silica is prepared by precipitation of silica from a soluble silicate solution containing electrolyte salts (e.g., $NaNO_3$, $Na_2SO_4$, $KNO_3$) while electrodialyzing, as described in U.S. Pat. No. 4,508,607 (Winyall), "Particulate Dialytic Silica". Fumed silicas (or pyrogenic silicas) are prepared from silicon tetrachloride by high-temperature hydrolysis, or other convenient methods.

In the preferred embodiment of this invention, the amorphous silica selected for use as the support will be a silica gel, preferably a hydrogel or an aerogel. The characteristics of hydrogels and aerogels are such that they effectively adsorb trace contaminants from glyceride oils and that they exhibit superior filterability as compared with other forms of silica. The selection of hydrogels and aerogels therefore will facilitate the overall refining process.

It is also preferred that the support will have the highest possible surface area in pores which are large enough to permit access to the free fatty acid molecules, while being capable of maintaining good structural integrity upon contact with the base and with the fluid media. The requirement of structural integrity is particularly important where the adsorbents are used in continuous flow systems, which are susceptible to disruption and plugging. Amorphous silicas suitable for use as supports in this process have surface areas of up to about 1200 square meters per gram, preferably between 10 and 1200 square meters per gram. It is preferred, as well, for as much as possible of the surface area to be contained in pores with diameters greater than 50 to 60 Angstroms, although supports with smaller pore diameters may be used. In particular, partially dried amorphous silica hydrogels having average pore diameters less than 50 Angstroms (i.e., down to about 20 Angstroms) and having a moisture content of at least about 25 wt % will be suitable. These surface area characteristics are applicable as well to other inorganic porous supports which may be used in this invention.

The method of this invention utilizes supports, such as the preferred amorphous silicas, with substantial porosity contained in pores having diameters greater than about 20 Angstroms, preferably greater than about 50 to 60 Angstroms, as defined herein, after appropriate activation. Activation for this measurement typically is by heating to temperatures of about 450° to 700° F. (230 to 360° C) in vacuum. One convention which describes silicas and other adsorbents is average median pore diameter ("APD"), typically defined as that pore diameter at which 50% of the surface area or pore volume is contained in pores with diameters greater than the stated APD and 50% is contained in pores with diameters less than the stated APD. Thus, in supports suitable for use in the method of this invention, at least 50% of the surface area pore volume will be in pores of at least 20 Angstroms, preferably 50 to 60 Angstroms, in diameter. Supports such as silicas with a higher proportion of pores with diameters greater than 50 to 60 Angstroms will be preferred, as these will contain a greater number of potential adsorption sites. The practical upper APD limit is about 5000 Angstroms.

Supports which have measured intraparticle APDs within the stated range will be suitable for use in this process. Alternatively, the required porosity may be achieved by the creation of an artificial pore network of interparticle voids in the 50 to 5000 Angstrom range. For example, non-porous silicas (i.e., fumed silica) can be used as aggregated particles. Supports, with or without the required porosity, may be used under conditions which create this artificial pore network. Thus, the criterion for selecting suitable inorganic porous supports for use in this process is the presence of an "effective average pore diameter" greater than 20 Angstroms, preferably greater than 50 to 60 Angstroms. This term includes both measured intraparticle APD and interparticle APD, designating the pores created by aggregation or packing of support particles.

The APD value (in Angstroms) can be measured by several methods or can be approximated by the following equation, which assumes model pores of cylindrical geometry:

$$APD\ (\text{Angstroms}) = \frac{40{,}000 \times PV\ (\text{cc/gm})}{SA\ (\text{m}^2/\text{gm})}, \quad (1)$$

where PV is pore volume (measured in cubic centimeters per gram) and SA is surface area (measured in square meters per gram).

Both nitrogen and mercury porosimetry may be used to measure pore volume in for example xerogels, precipitated silicas and dialytic silicas. Pore volume may be measured by the nitrogen Brunauer-Emmett-Teller ("B-E-T") method described in Brunauer et al., J. Am. Chem. Soc., Vol. 60, p. 309 (1938). This method depends on the condensation of nitrogen into the pores of activated silica and is useful for measuring pores with diameters up to about 600 Angstroms. If the sample contains pores with diameters greater than about 600 Angstroms, the pore size distribution, at least of the larger pores, is determined by mercury porosimetry as described in Ritter et al., Ind. Eng. Chem. Anal. Ed. 17,787 (1945). This method is based on determining the pressure required to force mercury into the pores of the sample. Mercury porosimetry, which is useful from about 30 to about 10,000 Angstroms, may be used alone for measuring pore volumes in silicas having pores with diameters both above and below 600 Angstroms. Alternatively, nitrogen porosimetry can be used in conjunction with mercury porosimetry for these silicas. For measurement of APDs below 600 Angstroms, it may be desired to compare the results obtained by both methods. The calculated PV volume is used in Equation (1).

For determining pore volume of hydrogels, a different procedure, which assumes a direct relationship between pore volume and water content, is used. A sample of the hydrogel is weighed into a container and all water is removed from the sample by vacuum at low temperatures (i.e., about room temperature). The sample is then heated to about 450° to 700° F. (230° to 360° C.) to activate. Alternatively, the sample may be dried and activated by ignition in air at 1750° F. (955° C.). After activation, the sample is re-weighed to determine the weight of the silica on a dry basis, and the pore volume is calculated by the equation:

$$PV\ (\text{cc/gm}) = \frac{\%\ TV}{100 - \%\ TV}, \quad (2)$$

where TV is total volatiles (or weight percent moisture), determined as in the following equation by the wet and dry weight differential:

$$TV = 100 \times \left[\frac{\text{Silica (as is, gm)} - \text{Silica (db, gm)}}{\text{Silica (as is, gm)}}\right]. \quad (3)$$

The surface area measurement in the APD equation is measured by the nitrogen B-E-T surface area method, described in the Brunauer et al., article, supra. The surface area of all types of appropriately activated amorphous silicas can be measured by this method. The measured SA is used in Equation (1) with the measured PV to calculate the APD of the silica.

The purity of the support used in this invention is not believed to be critical in terms of the adsorption of free fatty acids and other contaminants. However, where the finished product is intended to be food grade oil, care should be taken to ensure that the base-treated adsorbent used does not contain leachable impurities which could compromise the desired purity of the product. Where the support is amorphous silica, it is preferred, therefore, to use a substantially pure amorphous silica. Minor amounts, i.e., less than about 10%, of other inorganic constituents may be present in the supports. For example, suitable silicas may comprise iron as $Fe_2O_3$, aluminum as $Al_2O_3$, titanium as $TiO_2$, calcium as CaO, sodium as $Na_2O$, zirconium as $ZrO_2$, and/or trace elements. It is understood that the adsorbents of this invention may be used alone or in combination with untreated supports or other types of adsorbents useful for removing various contaminants which may be present.

The inorganic porous support is treated with a base in such a manner that at least a portion of said base is retained in at least some of the pores of said support, resulting in the base-treated inorganic porous adsorbent of this invention. The base should be selected such that it will not have any substantially adverse affect on the structural integrity of the adsorbent. Conveniently, the base is selected from the group consisting of sodium carbonate, sodium bicarbonate, potassium carbonate, calcium hydroxide, magnesium hydroxide, sodium hydroxide, potassium hydroxide, and mixtures and solutions thereof. Most conveniently, soda ash (sodium carbonate) is the preferred base. Soda ash is particularly preferred where amorphous silica is the porous support, since it does not cause decrepitation of the support. The bases may be used singly or in combination.

It is desired that at least a portion of the pores in the adsorbent contain either pure base or an aqueous base solution. When a base solution is used, it may be diluted to a concentration as low as about 0.05M, although the preferred concentration is generally at least about 0.25M. However, possible interaction between the base and support must be considered. For example, sodium hydroxide in higher concentrations (i.e., solutions above 5%) will cause decrepitation of a silica support. Therefore, sodium hydroxide should be used at lower concentration levels and dried quickly.

As stated, the inorganic porous support can be treated with a base in any manner that allows the base to enter at least a portion of the pores of the support. For example, the support may be slurried in the base or base solution for long enough for the base or solution to enter at least a portion of the pores of the support, typically a period of at least about one half hour, up to about twenty hours. The slurry preferably will be agitated during this period to increase entry of the base into the pore structure of the support. The base-treated adsorbent is then conveniently separated from the solution by filtration. Alternatively, the base solution can be introduced to the support in a fixed bed configuration, for a similar period of contact. This would be particularly advantageous for treating unsized, washed silica hydrogel, since it would eliminate the standard dewatering-/filtration step in processing the hydrogel.

Another method for base-treating porous inorganic supports is to impregnate the support with a solution of base to about 70% to 100% (saturated) incipient wetness. Incipient wetness refers to the percent absorbent capacity of the support which is used. For example, flash dried, milled silica gel may be treated in this manner. Still another method for this base-treatment is to introduce a fine spray or jet of the base solution to the support, preferably as it is fed to a milling/sizing operation. For this method, it will be preferred to use a concentrated base. This latter method will be preferred for treating amorphous silica in a commercial scale operation.

Still another preferred method, where the support is an amorphous silica hydrogel, is to treat the hydrogel with base simply by blending or physically mixing the hydrogel with I0 solid base particles. This method may be used with hydrogels having total volatiles of at least about 40 wt %, preferably about 55 to 65 wt %, and preferably less than about 70 wt %. Each ingredient may be milled prior to blending or they may be co-milled by known milling techniques.

The base-treated adsorbents preferably are used wet, but may be dried to any desired total volatiles content. However, it has been found that the moisture total volatiles content of the base-treated inorganic porous adsorbent can have an important effect on the filterability of the adsorbent from the oil, although it does not necessarily affect adsorption itself. The presence of about 10 to about 80 wt %, preferably at least about 30 wt %, most preferably at least about 60 wt %, water in the pores of the adsorbent (measured as weight loss on ignition at 1750° F. (955° C.)) is preferred for improved filterability. The greater the moisture content of the adsorbent, the more readily the mixture filters. This improvement in filterability is observed even at elevated oil temperatures which would tend to cause the water content of the adsorbent to be substantially lost by evaporation.

The Adsorption Process—The adsorption step in the disclosed process of removing contaminants from the oil is accomplished by conventional methods in which the base-treated inorganic porous adsorbent and the oil are contacted, preferably in a manner which facilitates the adsorption. Any convenient batch or continuous process may be used. In any case, agitation or other mixing will enhance the contaminant removal efficiency of the base-treated adsorbent. If desired, vacuum may be applied to the oil/adsorbent mixture in order to facilitate removal of water which may be present in the oil. Sufficient time (e.g., at least about 5 to 20 minutes) should be allowed for oil-adsorbent contact with agitation, prior to applying the vacuum.

The removal of contaminants by adsorption may be conducted at any convenient temperature at which the oil is a liquid. The glyceride oil and base-treated inorganic porous adsorbent are contacted as described above for a period sufficient to achieve the desired depleted contaminant level in the treated oil. The specific contact time will vary 5 somewhat with the selected process, e.g., batch or continuous, and with the condition of the oil to be treated. In addition, the adsorbent usage, that is, the relative quantity of adsorbent brought into contact with the oil, will affect the amount of contaminants removed. The adsorbent usage may be quantified as the weight percent of adsorbent (on a dry weight basis after ignition at 1750° F. (955° C.)), calculated on the weight of the oil processed.

The adsorbent usage may be from about 0.005 to about 5 wt %, preferably from about 0.01 to about 1.5 wt %, more preferably from about 0.05 to about 1 wt %, dry basis, as described above. As seen in the Examples, significant reduction in contaminant content may be achieved by the method of this invention. At a given adsorbent loading, the base-treated adsorbent of this invention will significantly outperform untreated adsorbent in reducing the contaminant content of the glyceride oil. The specific contaminant content of the treated oil will depend primarily on the oil itself, as well as on the adsorbent, usage, process, etc. However, FFA levels of less than about 3.0 wt %, preferably less than about 1.0 wt %, more preferably less than about 0.05 wt %, and most preferably less than about 0.03 wt %, can be achieved, particularly by adjusting the adsorbent loading or by selecting one of the more efficient adsorbents. It will be understood that oils treated in accordance with the invention may still contain FFAs as well as other contaminants. The FFA content of the treated oil will depend, inter alia, on the initial FFA level of the oil as well as the nature and quantity of other contaminants, as there is a complex interaction between the various contaminants. The FFAs not removed by the method of the invention can be removed by distilling out in a deodorizer, by steam stripping, or by other convenient means.

It is preferred to add base-treated adsorbent to the oil in an amount calculated as being sufficient to neutralize at least about 70% of the free fatty acid contaminants. It may be desired to use the adsorbent of this invention for removal of up to 100% of the FFA, although there are other methods for removing residual quantities of FFA, as discussed above. Where up to 100% removal is desired, it is preferable to add a stoichiometric excess of base-treated adsorbent, relative to the FFA content (for example, up to about a 25% excess based on FFA content).

Glyceride oil characteristics vary considerably and have substantial impact on the ease with which FFAs and other contaminants can be removed by the various physical or chemical processes. Although it is believed that FFA and base react to create soaps, the actual soap levels following addition of the base-treated adsorbent may not correspond to the theoretical soap levels predicted by the stoichiometry of the acid-base (FFA-base) reaction. Other acid-base reactions may occur upon addition of the adsorbent, depending on the nature and quantity of contaminants in the oil. For example, if phosphorus is present as phosphatidic acid, particularly in high concentrations, the base will preferentially neutralize that acid, rather than the FFAs which may be present. It will be appreciated, therefore, that in oils with high phosphorus and low FFA contents, considerably less than stoichiometric (theoretical) amounts of soap may be formed. As another example, the presence of calcium or magnesium ions affects adsorption of contaminants, as do phosphorus level and source of oil (e.g., palm, soy, etc.). By adding an excess over theoretical, reduction of up to 100% of the initial FFA will be possible.

Following removal of contaminants in accordance with this invention, the adsorbent is separated from the contaminant-depleted oil by any convenient means, such as by filtration. The glyceride oil treated in accordance with this invention may be subjected to additional finishing processes, such as steam refining, bleaching and/or deodorizing.

The method described herein may reduce the levels of free fatty acids and other contaminants sufficiently, depending on the base-treated inorganic porous adsorbent chosen, to eliminate the need for bleaching earth steps in the initial refining of glyceride oils. Even where bleaching earth operations are to be employed for decoloring the oil, treatment with both the base-treated inorganic porous adsorbent of this invention and bleaching earth provides an extremely efficient overall process. Such combined treatment may be either sequential or simultaneous. For example, by first using the method of this invention to decrease the FFA content, and then treating with bleaching earth, the latter step is more effective, with the result that either the quantity of bleaching earth required can be significantly reduced, or the bleaching earth can operate more effectively per unit weight.

Spent frying oil reclaimed in accordance with this invention may be subjected to addition treatments known to those in the art to further reduce levels of contaminants. For example, it may be desired to further reduce FFA content by steam stripping, if the quantities justify the economics of that operation. Other treatments may be desired.

The examples which follow are given for illustrative purposes and are not means to limit the invention described herein. The following abbreviations have been used throughout in describing the invention:

| | |
|---|---|
| A | Angstrom(s) |
| ads. | adsorbent |
| APD | average pore diameter |
| APS | average particle size |
| B-E-T | Brunauer-Emmett-Teller |
| cc | cubic centimeter(s) |
| cm | centimeter |
| °C. | degrees Centigrade |
| °F. | degrees Fahrenheit |
| FFA | free fatty acid |
| gm | gram(s) |
| ICP | Inductively Coupled Plasma |
| m | meter |
| Mg | magnesium |
| min | minutes |
| ml | milliliter(s) |
| ppm | parts per million |
| % | percent |
| PV | pore volume |
| RH | relative humidity |
| SA | surface area |
| SBO | soybean oil |
| sec | seconds |
| TV | total volatiles |
| wt | weight |

EXAMPLE I

The silica aerogel used to make the adsorbents of this example was a spray dried silica gel, about 12μ average particle size (APS), surface area (SA) about 300 $m^2/gm$ with a pore volume of 1.5 cc/gm. Quantities of the gel were saturated with the aqueous base solutions indicated in Table I. The adsorbents were used either as prepared or as dried to the total volatiles content (TV) indicated in the table.

Spent peanut oil having an initial free fatty acid content of 0.35 wt % was heated at 100° C. in a covered glass beaker. Adsorbent then was added, on a dry weight basis (%db), to the desired loading. The resulting hot oil/adsorbent mixture was agitated for one-half hour at 100° C. without vacuum. The mixture then was filtered, leaving spent adsorbent on the filter and allowing clean oil to pass through. The oil was analyzed for free fatty acids by titration with sodium hydroxide, using a phenolphthalein indicator. Table I indicates the remaining FFA in the oil as weight percent and the capacity of the tested adsorbents for removing FFA.

TABLE I

| Ads. | Base | TV (wt %) | Loading (wt %, db) | FFA (wt %) | Removal Capacity (%)[1] |
|---|---|---|---|---|---|
| — | — | — | — | 0.35 | — |
| IA | 20 wt % $Na_2CO_3$ | 57 | 0.22 | 0.07 | 127 |
| IA | 20 wt % $Na_2CO_3$ | 57 | 0.42 | 0.07 | 76 |
| IA | 20 wt % $Na_2CO_3$ | 57 | 0.64 | 0.02 | 52 |
| IB | 20 wt % $Na_2CO_3$ | 10 | 0.40 | 0.13 | 55 |
| IB | 20 wt % $Na_2CO_3$ | 10 | 0.60 | 0.10 | 42 |
| IB | 20 wt % $Na_2CO_3$ | 10 | 0.80 | 0.06 | 36 |
| IC | 9 wt % $NaHCO_3$ | 60 | 0.80 | 0.04 | 39 |
| ID | 8 wt % NaOH | 10 | 0.40 | 0.15 | 50 |
| ID | 8 wt % NaOH | 10 | 0.80 | 0.08 | 34 |

[1]Removal capacity is FFA removed per adsorbent used, expressed as percent:

$$\text{Removal Capacity (\%)} = \frac{\text{initial FFA (wt \%)} - \text{final FFA (wt \%)}}{\text{loading (wt \%, db)}}$$

EXAMPLE II

Adsorbents IIA–IIE were tested to determine whether the FFA content of oil could be reduced without increasing the soap content. Spent peanut oil having an initial FFA content of 0.35 wt % and an initial soap content of about 2400 ppm was treated with each of the adsorbents as shown in Table II.

The adsorbents were prepared by treating the silica aerogel of Example I with the solution of base (either sodium carbonate or sodium bicarbonate) to give the indicated soda ($Na_2O$) level and drying to the degree of moisture indicated in Table II. The adsorbents then were added to the oil samples, to the indicated loadings.

The resulting hot oil/adsorbent was agitated for 20 min. at 100° C. under vacuum. The mixture was then filtered, leaving spent adsorbent on the filter and allowing clean oil to pass through. The oil was analyzed as in Example I. Soap was measured by American Oil Chemist Society (AOCS) recommended practice Cc 17-79.

TABLE II

| Ads. | Base | $Na_2O$ (wt %) | TV (wt %) | Loading (wt %, db) | FFA (wt %) | Soap (ppm) |
|---|---|---|---|---|---|---|
| — | — | — | — | — | 0.350 | 2400 |
| IIA | 10 wt % $Na_2CO_3$ | 3.9 | 60 | 0.8% | 0.080 | 600 |
| IIB | 10 wt % $Na_2CO_3$ | 8.0 | 10 | 0.8% | 0.170 | 3200 |
| IIC | 15 wt % $NaHCO_3$ | 3.9 | 60 | 0.8% | 0.120 | 3100 |
| IID | 15 wt % $NaHCO_3$ | 8.0 | 10 | 0.8% | 0.160 | 3800 |
| IIE | 6.5 wt % $Na_2CO_3$ | 3.9 | 60 | 0.6% | 0.130 | 960 |
| IIE | 6.5 wt % $Na_2CO_3$ | 3.9 | 60 | 0.8% | 0.097 | 640 |
| IIE | 6.5 wt % $Na_2CO_3$ | 3.9 | 60 | 0.8% | 0.055 | 500 |
| IIE | 6.5 wt % $Na_2CO_3$ | 3.9 | 60 | 1.0% | 0.130 | 720 |
| IIE[1] | 6.5 wt % $Na_2CO_3$ | 3.9 | 60 | 0.8% | 0.055 | 120 |

[1]The filtered oil was further treated with 1.0 wt % (as is) "TriSyl" silica (commercially available from Davison Chemical Division, W.R. Grace & Co.-Conn., Baltimore, MD) to remove residual soaps.

EXAMPLE III

Spent peanut oil having an initial FFA content of 0.35 wt % was treated according to the procedures of Example I, using the adsorbents of Table III. It can be seen from the results shown in Table III that adsorbents IIIA–IIIF remove FFA from spent peanut oil.

TABLE III

| Ads. | Base | TV (wt %) | Loading (wt %, db) | FFA (wt %) |
|---|---|---|---|---|
| — | — | — | — | 0.35 |
| IIIA | 20 wt % $Na_2CO_3$ | 57.3 | 0.22 | 0.07 |

TABLE III-continued

| Ads. | Base | TV (wt %) | Loading (wt %, db) | FFA (wt %) |
|---|---|---|---|---|
| IIIA | 20 wt % $Na_2CO_3$ | 57.3 | 0.42 | 0.03 |
| IIIA | 20 wt % $Na_2CO_3$ | 57.3 | 0.64 | 0.02 |
| IIIB | 11 wt % $Na_2CO_3$ | 58.3 | 0.42 | 0.03 |
| IIIC[1] | 6.5 wt % $Na_2CO_3$ | 51.5 | 0.48 | 0.04 |
| IIID | 15 wt % $Na_2CO_3$ | 10.3 | 0.40 | 0.13 |
| IIID | 15 wt % $Na_2CO_3$ | 10.3 | 0.40 | 0.17 |
| IIID | 15 wt % $Na_2CO_3$ | 10.3 | 0.60 | 0.10 |
| IIID | 15 wt % $Na_2CO_3$ | 10.3 | 0.80 | 0.06 |
| IIID | 15 wt % $Na_2CO_3$ | 10.3 | 0.80 | 0.09 |
| IIID | 15 wt % $Na_2CO_3$ | 10.3 | 1.20 | 0.09 |
| IIID | 15 wt % $Na_2CO_3$ | 10.3 | 1.60 | 0.09 |
| IIIE | 20 wt % $Na_2CO_3$ | 8.3 | 0.40 | 0.20 |
| IIIE | 20 wt % $Na_2CO_3$ | 8.3 | 0.80 | 0.12 |
| IIIE | 20 wt % $Na_2CO_3$ | 8.3 | 0.80 | 0.11 |
| IIIF | 25 wt % $Na_2CO_3$ | 10.8 | 0.40 | 0.19 |
| IIIF | 25 wt % $Na_2CO_3$ | 10.8 | 0.40 | 0.12 |
| IIIF | 25 wt % $Na_2CO_3$ | 10.8 | 0.80 | 0.11 |
| IIIF | 25 wt % $Na_2CO_3$ | 10.8 | 0.80 | 0.09 |

[1]Impregnated with base to only 70% incipient wetness (vs. saturation for the other adsorbents in the table).

EXAMPLE IV

A series of adsorbents of the invention were prepared using various inorganic porous supports. The untreated supports were used as controls. For preparation of the adsorbents, the supports (100 gm) were impregnated to 95% incipient wetness with a 20 wt % soda ash solution to give the soda level (wt % $Na_2O$) indicated in Table IV.

Each adsorbent was then slurried into soybean oil to a loading of 1.0 wt % (db). The SBO had an initial FFA content of 0.52 wt % and an initial soap level of 0 ppm. The mixture was blended at 95° C. for 30 minutes under vacuum and then filtered to remove absorbent. The same oil treatment procedures were used for the controls. FFA and soap levels were determined by titration with normalized NaOH and HCl solutions, respectively. Results are shown in Table IV.

TABLE IV

| | $Na_2O$ (wt %) | TV (wt %) | FFA (wt %) | Soap (ppm) |
|---|---|---|---|---|
| — | — | — | 0.52 | 0 |
| Base-Treated Ads. | | | | |
| Diatomaceous Earth[1] | 13.4 | 41.3 | 0.18 | 20 |
| Acid Activated Bleaching Earth[2] | 10.8 | 38.6 | 0.39 | 70 |
| Neutral Clay[3] | 8.3 | 35.8 | 0.24 | 46 |
| Alumina[4] | 10.3 | 54.4 | 0.09 | 20 |
| Magnesium Silicate[5] | 19.2 | 56.1 | 0.14 | 18 |
| Aluminum Silicate[6] | 10.5 | 45.6 | 0.30 | 52 |
| Silica aerogel[7] | 16.4 | 59.2 | 0.03 | 6 |
| Controls | | | | |
| Diatomaceous Earth[1] | — | .93 | 0.52 | 0 |
| Acid Activated Bleaching Earth[2] | — | 18.7 | 0.50 | 0 |
| Neutral Clay[3] | — | 18.7 | 0.50 | 0 |
| Alumina[4] | — | 34.7 | 0.30 | 0 |
| Magnesia Silica[5] | — | 25.2 | 0.42 | 15 |
| Alumina Silica[6] | — | 18.4 | 0.44 | 0 |

[1]"Celite" DE, Manville Corp., Denver CO.
[2]"Filtrol 105" bleaching earth, Englehardt Corp., Edison NJ.
[3]"Pure Flo B80" clay, Oil-Dri, Chicago IL.
[4]"SRA 146" alumina, Davison Chemical Division, W. R. Grace & Co.-Conn., Baltimore MD.
[5]"Magnasol 30-40" magnesium silicate, Research Chemicals, Phoenix AZ.
[6]"[illegible]5-13" aluminum silicate, Davison Chemical Division, W. R. Grace & Co.-Conn., Baltimore MD.
[7]Davison Chemical Division, W. R. Grace & Co.-Conn., Baltimore MD. No corresponding control was run for this adsorbent, since it was previously known that untreated amorphous silica does not remove FFA.

EXAMPLE V

ID silica hydrogel (Davison Chemical Division, W. R. Grace & Co.-Conn., Baltimore, Md.) was milled and dried to 20μ APS, 4wt % TV. The silica had a water pore volume of 1.60 cc/gm. Next, 100 gm quantities of this silica were impregnated with 155 cc of a 2.2N solution of one of the bases listed in Table V. That is, the supports were impregnated to 10% $Na_2O$ or the molar equivalent, to ensure equivalent neutralizing power. The TV of each adsorbent was about 60 wt %. Each adsorbent, at the indicated loading, was slurried into 100 gm of soybean oil having an initial FFA content of 0.52 wt % and an initial soap content of 0 ppm. The loadings were adjusted to represent equal molar amounts of the alkali or alkaline earth added tot he oil sample, after accounting for light TV and impregnation variations (determined analytically). Treatment was continued for 30 minutes at 95° C. under vacuum, after which the adsorbents was filtered off. FFA and soap levels were measured as in Example IV.

TABLE V

| Ads. | Base | Loading[1] (wt %, db) | FFA (%) | Soap (ppm) |
|---|---|---|---|---|
| — | — | — | 0.52 | 0 |
| VA | $Na_2CO_3$ | 1.57 | 0.08 | 12 |
| VB | NaOH | 1.62 | 0.12 | 15 |
| VC | $Ca(OH)_2$ | 1.54 | 0.32 | 9 |
| VD | $Mg(OH)_2$ | 1.48 | 0.46 | 21 |
| VE | $Na_5P_3O_{10}$ | 1.31 | 0.48 | 18 |
| VF | $K_2CO_3$ | 1.41 | 0.15 | 76 |

[1]All loadings represent the amount of adsorbent calculated as being necessary to remove substantially all FFA if the process goes to completion.

EXAMPLE VI

In this Example, three different methods of applying sodium carbonate to silica supports were investigated. "Addition" refers to blending 100 gm milled support with 7.6 gm solid $Na_2CO_3$ particles milled to 3μ APS. "Impregnation" refers to saturating a flash-dried, milled support with soda ash solution. "Soak" refers to slurrying a milled support in soda ash solution and then filtering. In all cases, the support was milled to 20μ APS. In all cases, sodium carbonate was applied to reach the indicated soda ($na_2O$) level. The SBO of Example IV was treated with each adsorbent according to the procedures of Example IV. The results are shown in table VI.

TABLE VI

| Method/Support | TV (wt %) | $Na_2O$ (wt %) | Loading (wt %, db) | FFA (wt %) | Soap (ppm) |
|---|---|---|---|---|---|
| — | — | — | — | 0.52 | 0 |
| Addition | | | | | |
| TriSyl silica gel | 64.8 | 11.83 | 1.33 | 0.09 | 3 |
| ID silica gel | 62.1 | 10.40 | 1.41 | 0.06 | 0 |
| Impregnation | | | | | |
| TriSyl silica gel | 58.7 | 9.1 | 1.48 | 0.12 | 6 |
| ID silica gel | 65.5 | 10.0 | 1.57 | 0.08 | 12 |
| Soak | | | | | |
| TriSyl silica gel | 72.0 | 14.9 | 1.33 | 0.12 | 18 |

EXAMPLE VII

In this Example, the effect of sodium carbonate level in the base-treated adsorbent was tested. All adsorbents in this Example were made by impregnating soda ash solution into dried, milled (20μ APS) silica gel as described in Example VI. Various loadings represent theoretical 100% neutralization of FFA, based on $Na_2O$ content. The oil treated was the soybean oil of Example IV. The results are shown in Table VII.

TABLE VII

| Ads. | $Na_2O$ (wt %) | Loading (wt %, db) | FFA (wt %) | Soap (ppm) |
|---|---|---|---|---|
| — | — | — | 0.52 | 0 |
| VIIA | 10.03 | 1.33 | 0.08 | 12 |
| VIIB | 16.66 | 0.83 | 0.09 | 6 |
| VIIC | 20.22 | 0.63 | 0.10 | 3 |
| VIID | 25.42 | 0.54 | 0.17 | 15 |

EXAMPLE VIII

In this Example, an adsorbent of this invention was tested for its ability to reclaim spent frying oil at three different temperatures. The adsorbent was prepared by comilling 10 lb TriSyl silica gel with 1.1 lb $Na_2CO_3$ to generate an adsorbent with a soda level ($Na_2O$) of 15 wt %. The adsorbent loading (2.7 wt %, db) was based on a 125% theoretical neutralization of FFA. Reclamation was carried out on "Mel-Fry" frying oil (Bunge Oil Corp., Bradley Ill.) which had been in use for about 7 days prior to testing, with oil samples being heated to the three indicated temperatures prior to testing. The control data is for room temperature oil with no adsorbent treatment. Results are shown in Table VIII.

TABLE VIII

| Oil Temp. | FFA (wt %) | Soap (ppm) | P (ppm) | Cu (ppm) | Ca (ppm) | Mg (ppm) | Fe (ppm) |
|---|---|---|---|---|---|---|---|
| Control | 1.55 | — | 1.08 | 0.05 | 0.16 | 0.14 | 0.44 |
| 70° C. | 0.55 | 213 | <0.25 | 0.01 | 0.09 | 0.04 | <0.03 |
| 100° C. | 0.55 | — | 0.26 | 0.02 | 0.08 | 0.05 | 0.05 |
| 177° C. | 0.36 | — | 0.31 | 0.00 | 0.08 | 0.03 | <0.03 |

EXAMPLE IX

In this Example, a comparison was made between addition of an adsorbent of the invention and the sequential addition of the untreated support followed by soda ash solution. SBO with an initial FFA content of 0.52 wt % and 0 ppm soap was treated either with the adsorbent or with the untreated support plus base. The adsorbent was prepared by impregnating a silica aerogel (12μ APS) with soda ash to a soda level of 10 wt %. For the sequential treatment, the same quantities of soda ash and aerogel were separately added to the oil, however there was no pre-impregnation of the support with base. The results are shown in Table IX.

TABLE IX

| Treatment | FFA (wt %) | Soap (ppm) |
|---|---|---|
| — | 0.52 | 0 |
| Adsorbent | 0.07 | 0 |
| Suport + base | 0.08 | 15 |

The principles, preferred embodiments and modes of operation of the present invention have been described in the foregoing specification. The invention which is intended to be protected herein, however, it not to be construed as limited to the particular forms disclosed, since these are to be regarded as illustrative rather than restrictive. Variations and changes may be made by those skilled in the art without departing from the spirit of the invention.

What is claimed is:

1. A process for the removal of contaminants, said contaminants being selected from the group consisting of free fatty acids, soaps, phosphorous, metal ions and color bodies from glyceride oil comprising:
   (a) selecting a glyceride oil with a free fatty acid content of greater than about 0.01% by weight;
   (b) selecting a porous amorphous silica hydrogel support;
   (c) treating said support with a base in such a manner that at least a portion of said base is retained in at least some of the pores of the support to yield a base-treated hydrogel adsorbent containing about 30–80 wt. % water;
   (d) contacting the glyceride oil of step (a) with the base-treated adsorbent of step (c) for a time sufficient for at least a portion of said free fatty acids to be converted to soaps and for at least a portion of said contaminants to be removed from said glyceride oil; and
   (e) separating the contaminant-depleted glyceride oil from the adsorbent.

2. The process of claim 1 wherein the porous support of step (b) has at least some pores of sufficient size to permit access to at least some free fatty acids.

3. The process of claim 1 wherein said hydrogel is treated with the base in step (c) by co-milling the base with the hydrogel to form said base-treated adsorbent.

4. The process of claim 1 wherein the base step (c) is selected from the group consisting of sodium carbonate, sodium bicarbonate, potassium carbonate, calcium hydroxide, magnesium hydroxide, sodium hydroxide, potassium hydroxide, and solutions and mixtures thereof.

5. The process of claim 1 wherein step (c) comprises treating the support with said base or a solution of said base to an incipient wetness in the range of about 70% to 100%.

6. The process of claim 1 wherein step (c) comprises treating said support with a base by blending said support with solid particles of base, said support having a total volatiles content of at least about 40 percent.

7. The process of claim 1 wherein step (c) comprises treating said support with a base by co-milling said support with solid particles of base, said support having a total volatiles content of at lease about 40 percent.

8. The process of claim wherein step (c) comprises treating said support with a base by saturating said support with said base or a solution of said base.

9. The process of claim wherein step (c) comprises treating said support with a base by soaking said support in said base or a solution of said base and filtering the base-treated adsorbent from the solution.

10. The process of claim 1 in which said base-treated adsorbent of step (c) is present in step (d) in an amount calculated as sufficient to remove at least about 70% of said free fatty acids in said oil.

11. The process of claim 1 in which said base-treated adsorbent of step (c) is present in step (d) in an amount calculated as sufficient to remove about 100% of said free fatty acids in said oil.

12. The process of claim wherein said base-treated adsorbent of step (c) is present in step (d) in an amount sufficient to reduce the free fatty acid content of said oil to less than about 0.05 weight percent.

13. The process of claim 1 wherein said base-treated absorbent of step (c) is present in step (d) in an amount from about 0.005 weight percent to about 5.0 weight percent, dry basis.

14. The process of claim 1 wherein said base-treated absorbent of step (c) is present in step (d) in an amount from about 0.01 weight percent to about 1.5 weight percent, dry basis.

15. The process of claim 1 wherein said base-treated absorbent of step (c) is present in step (d) in an amount from about 0.05 weight percent to about i.0 weight percent, dry basis.

* * * * *